United States Patent [19]

Erana

[11] Patent Number: 4,989,661

[45] **Date of Patent: * Feb. 5, 1991**

[54] FORMATION OF FOUNDRY CORE BLOCKS

[76] Inventor: Augustin A. Erana, Zorrestea, 4 Poligono Industrial Ali-Gobeo, 01010 Vitoria Alava, Spain

[ * ] Notice: The portion of the term of this patent subsequent to Jun. 12, 2007 has been disclaimed.

[21] Appl. No.: 500,737

[22] Filed: Mar. 28, 1990

Related U.S. Application Data

[63] Continuation of Ser. No. 251,697, Sep. 29, 1988, Pat. No. 4,932,459.

[51] Int. Cl.[5] ..... B22C 9/10

[52] U.S. Cl. ..... 164/24; 164/137

[58] Field of Search ..... 164/18, 24, 137, 369, 164/370, 228, 232

[56] References Cited

U.S. PATENT DOCUMENTS

| | | | |
|---|---|---|---|
| 2,841,838 | 7/1958 | Covitt | 164/137 X |
| 3,727,671 | 4/1973 | Kawai | 164/137 X |
| 3,756,309 | 9/1973 | Nishiyama et al. | 164/369 |
| 4,559,989 | 12/1985 | Kawai et al. | 164/228 |

FOREIGN PATENT DOCUMENTS

| | | | |
|---|---|---|---|
| 60-121038 | 6/1985 | Japan | 164/137 |
| 62-13240 | 1/1987 | Japan | 164/137 |

*Primary Examiner*—Richard K. Seidel
*Assistant Examiner*—J. Reed Batten, Jr.
*Attorney, Agent, or Firm*—Helfgott & Karas

[57] ABSTRACT

Though holes are provided in a suitable area of the cores during the formation thereof in a first blowing machine, such that, on adjoining the cores, to form the block, and in the absence of additives between the contacting surfaces thereof, the through holes are placed one adjacent another. Then a housing is defined, which affects the entire block in a longitudinal direction, and which subsequently molds a mixture of sand and a binder material, similar to a core in a second blowing machine. The material after hardening, acts as a coupling and stiffening arrangement between the cores forming the block.

7 Claims, 6 Drawing Sheets

FORMATION OF FOUNDRY CORE BLOCKS

This is a continuation of application Ser. No. 251,697, filed Sept. 29, 1988 and now U.S. Pat. No. 4,932,459.

BACKGROUND OF THE INVENTION

The present invention relates to a method for the formation of foundry core blocks, such as, for example, used for obtaining blocks for engines or other machines, wherein an optimum coupling is achieved between the several cores making up the block, without the risk of a deviation in dimensions, and in a quick, simple and fully efficient operative process can be obtained.

As is known, in order to obtain foundry elements it is necessary to use molding cores, made from a combination of sand and binder material. In many cases, for practical purposes, dependins from the configuration of the core to be obtained, the core is divided into a plurality of parts made separately or independently and which will subsequently be coupled to form a single block, with the final configuration of the molding element.

In practice, according to current technology, and after obtaining the single cores, same are coupled by means of an adhesive which is applied to their respective contacting surfaces. An automatic line for making the blocks of cores for engine blocks has been suggested by applicant, which line includes, amongst other elements, a handler which displaces the individual cores from a machining tool to a piling table, on which acts an adhesive applying machine consisting of a truck which penetrates into the field of action of the piler and is provided with a series of nozzles for coupling of the cores in order to form the final block.

This solution, however, affords the following problems:

The application of the adhesive generates certain problems.

It requires a perfectly controlled application and quantification, for otherwise part of the adhesive extends to the outside of the block and is disintegrated when it comes into contact with molten metal upon subsequent use of the core block with the formation of pores.

The adhesive must be applied quickly and in abundance, in order that the piling process is sufficiently quick.

An excessively thick layer of adhesive may affect the dimensions of the block of cores as a whole, such that the block would not comply with the necessary tolerances required therefor.

Other means are also used for coupling or packing the cores, the more conventional means being those which make use of threaded braces and metal bands, amongst others. Obviously, these systems for coupling or packing imply a considerable loss of time, as well as being awkward and complicated.

SUMMARY OF THE INVENTION

It is an object of the present invention to provide an improved method for forming foundry core blocks.

In order to achieve the above object, the invention is based on the provision of an aperture or groove in a suitable area of each core. On a pre-assembly of the cores, to produce the block, all of such apertures or grooves are operatively faced or aligned with one another to form a single aperture or groove which is later filled with a mixture of sand and binder material, similar to that used for obtaining the cores themselves, and likewise with the aid, of a core blowing machine, whereby after hardening of the filling mixture in the aperture or groove, the material used acts as a means for joining all the cores making up the block having optimum properties of capacity, solidity and stiffness, and which is easy to handle.

Obviously, and in order to achieve this effect under optimum conditions before filling the aperture or channel of the cores comprising the block, same are stiffly fixed or joined to each other by means of, for example, a clamp or similar element in order to prevent the appearance of burrs which would subsequently have to be removed, with the resulting high cost thereof.

A further characteristic of the invention resides in that the apertures or channels in the cores are not of a uniform section, but rather that the mouths thereof, for example, are of a larger section than their middle areas, such that the block itself acts as a mold for filling the apertures thereof, and said filling material, upon hardening, establishes a groove-and-tongue coupling with each of the cores, thus strengthening the efficiency of the filling material as a coupling element for the cores, and ensuring a greater stiffness and easier handling of the block as a whole.

In accordance with the above, it can be inferred that the cores are obtained in two blowing operations and obviously in two different machines within the assembly comprising the installation. One part of the core, obviously the larger one, is obtained in the first blowing machine, leaving a groove, channel or aperture in each core, such that on assembly thereof to form the block the channels or apertures are placed in a continuous manner.

The finishing of the core is definitively obtained upon assembly of the block i.e., in the second blowing machine, this latter being obviously much simpler than the first.

In this second blowing machine, sand is blown directly into the continuous channel or aperture formed by assembly of the various cores. Thus, the mixture of sand and binder material will fill the channel or aperture, thereby finishing the core and coupling all the cores comprising the block.

It should be borne in mind that the composition of the sand-binder material used for making the core in the first blowing machine is of suitable characteristics for the core to be obtained. However, the composition of sand/binder agent used in the second blowing machine for finishing the core and obtaining the joining of the block may be, but is not necessarily, the same as that used in the first machine, due to the fact that coupling is effected at a point of the core which is normally for support, will not enter into contact with the molten material.

Furthermore, and in accordance with the improvements of the invention, it is inferred that the mold used in the second blowing machine is precisely the assembled block. Thus there is no core box or the like in the second machine, for the coupled block itself directly received the sand-binder mixture.

The aforementioned objects, features and advantages of the invention will, in part, be pointed out with particularity, and will, in part, become obvious from the following more detailed description of the invention, taken in conjunction with the accompanying drawing, which form an integral part thereof.

DETAILED DESCRIPTION OF THE PREFERRED EMBODIMENT

It should be pointed out in the first place that the basic configuration of the parts shown in the figures are only shown by way of example, and may vary widely depending on the final configuration to be adopted by the block of cores in accordance with the foundry block to be obtained.

Figure 1:
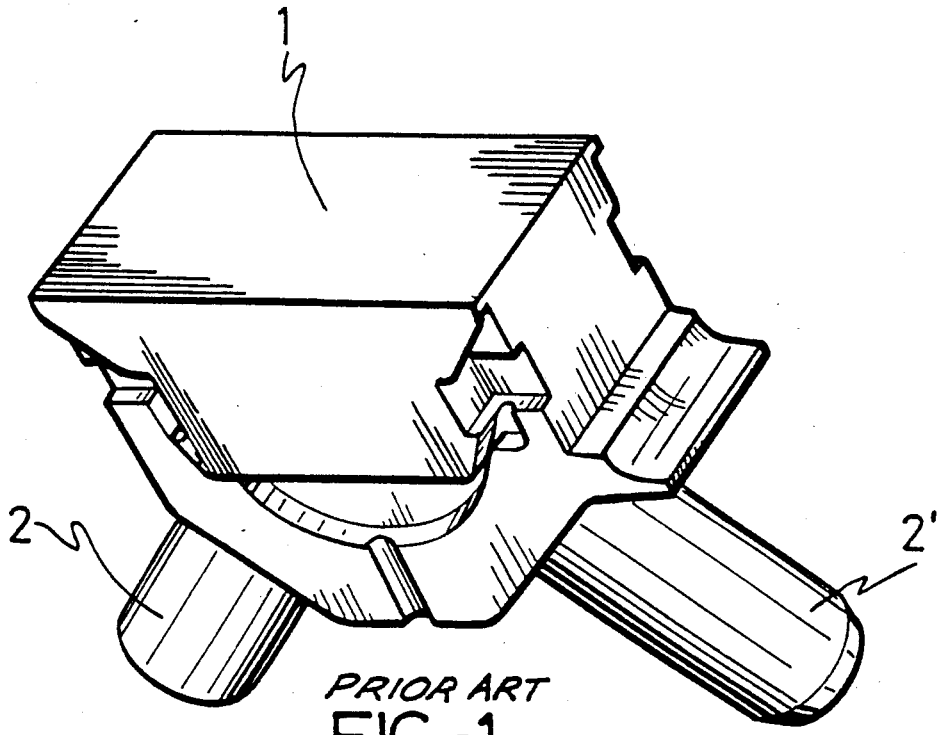
PRIOR ART FIG.-1
FIG. 1 shows a perspective view of a core which shall form part of a block, for the obtention of an engine block, and formed in a conventional manner, i.e., to be joined to the remaining cores of the block by means of adhesive material.

Specifically, and as already mentioned, FIG. 1 shows a core for obtaining a certain type of engine, wherein a body 1, basically prismatic in shape, and which comprises the core, is provided, from which two cylinders 2—2′ emerge in a V shape.

Figure 2:
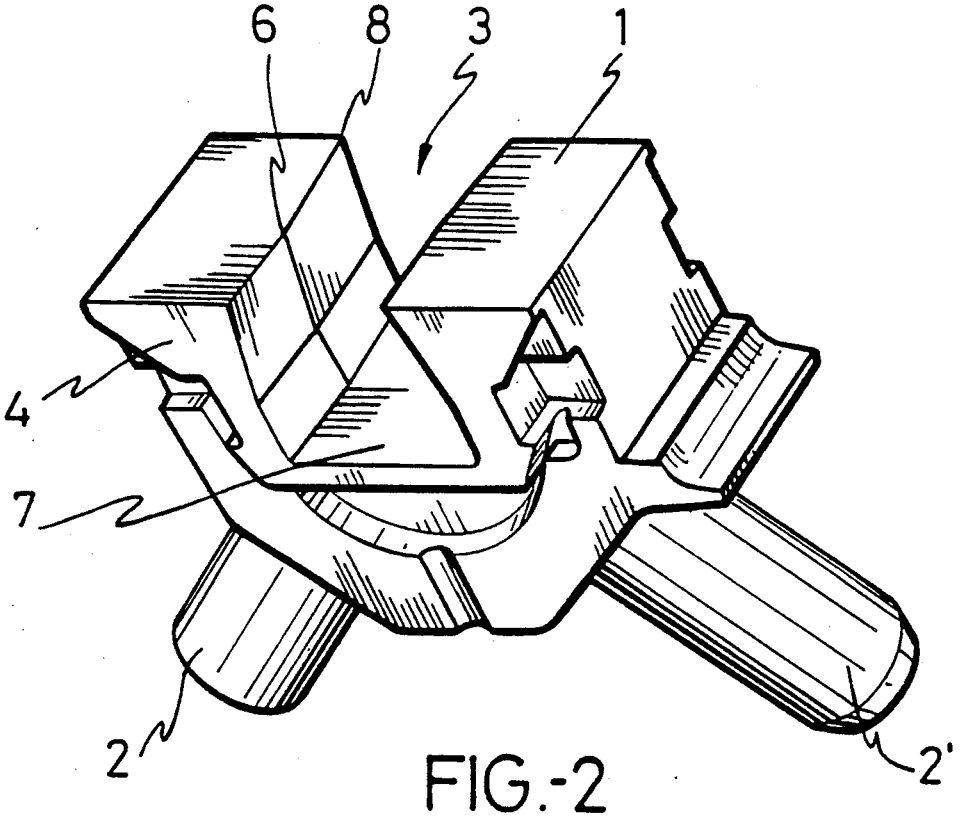
FIG. 2 shows the core of the preceding figure, likewise in a perspective view, but formed in accordance with the improvements of the present invention.

From this basic configuration of the core, determined by the specific and practical application thereof, the invention is based on the provision on the prismatic body 1, and in accordance with FIG. 2, of a large channel 3 which shall obviously affect all the cores comprising the block.

Figure 3:
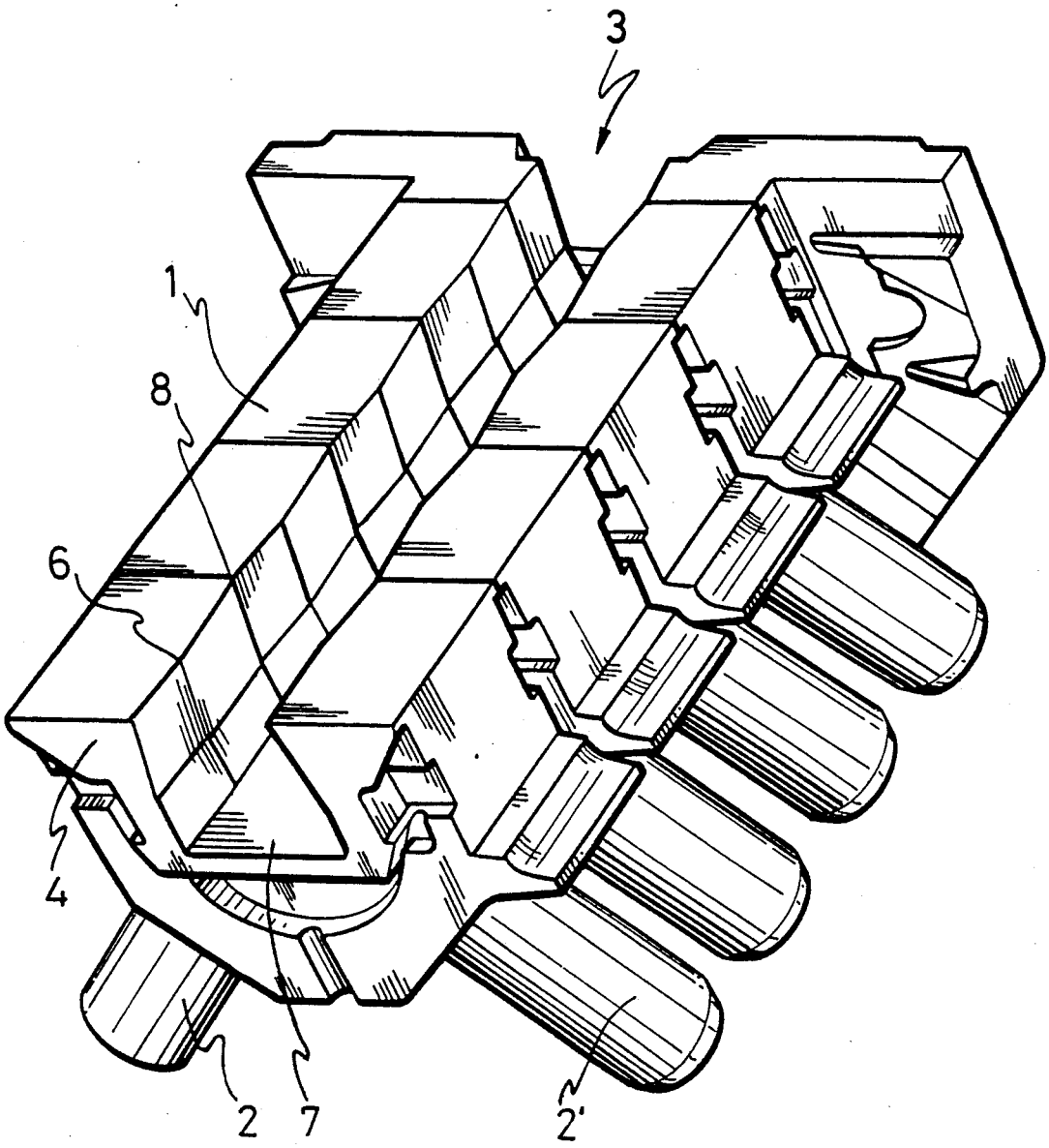
FIG. 3 shows an assembly of cores as the one shown in FIG. 2, duly coupled therebetween in accordance with the block of cores to be formed.
Figure 4:
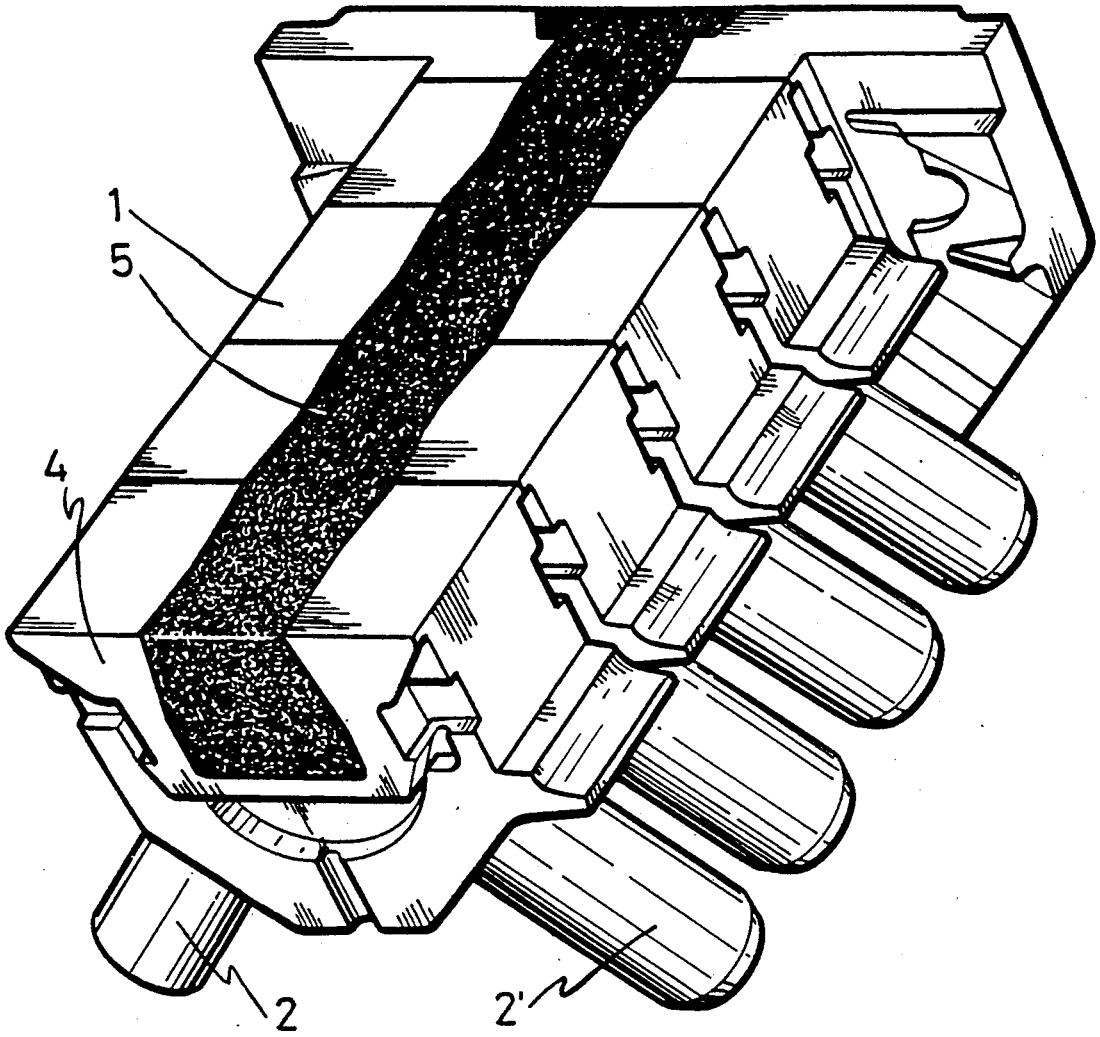
FIG. 4 shows the block of the preceding figure after filling of the channels fo the respective cores with the filling material which, upon hardening, forms the coupling means therebetween.

Based on cores 1 provided with the channel 3, the above described assembly shown in FIG. 3 shall be effected, wherein the respective channels 3 of all cores form one continuous channel, i.e., a block similar to that conventionally obtained with cores 1 is formed, but having the coupling surfaces 4 thereof directly in contact with each other, i.e., with layers of adhesive material thereon and with the longitudinal channel, formed by the individual channels 3. Subsequently, and obviously, with as perfect a coupling as possible between the different cores 1, the block thus obtained is used as a mold for filling channel 3 thereof, with a mixture of water and binder material 5, as shown in FIG. 4, which filling material is similar to that used for obtaining the cores 1 and is applied with channel 3 likewise with the aid of a core blowing machine.

Upon hardening of the filling material 5, and in addition to the disappearance of channel 3, i.e., the external configuration of the block of cores being identical to that of a conventional block, the filling material affords to the block optimum solidity, stiffness and compactness, rendering the block easy to handle.

As a complement to the above, and as a further characteristic of the invention, likewise mentioned before, channel 3 of each core 1 is provided with a slight narrowing 6 or any other irregular form at its middle section to avoid a constant section of the channel of the block, said channel 3 likewise having a larger section at end 7 than at the mouth 8, such that between the filling material 5 and the individual cores forming the block there is established a groove-and-tongue effect in both a longitudinal and transversal direction, which ensures greater solidity and stiffness of the block, i.e., coupling means may vary greatly.

Figure 5:
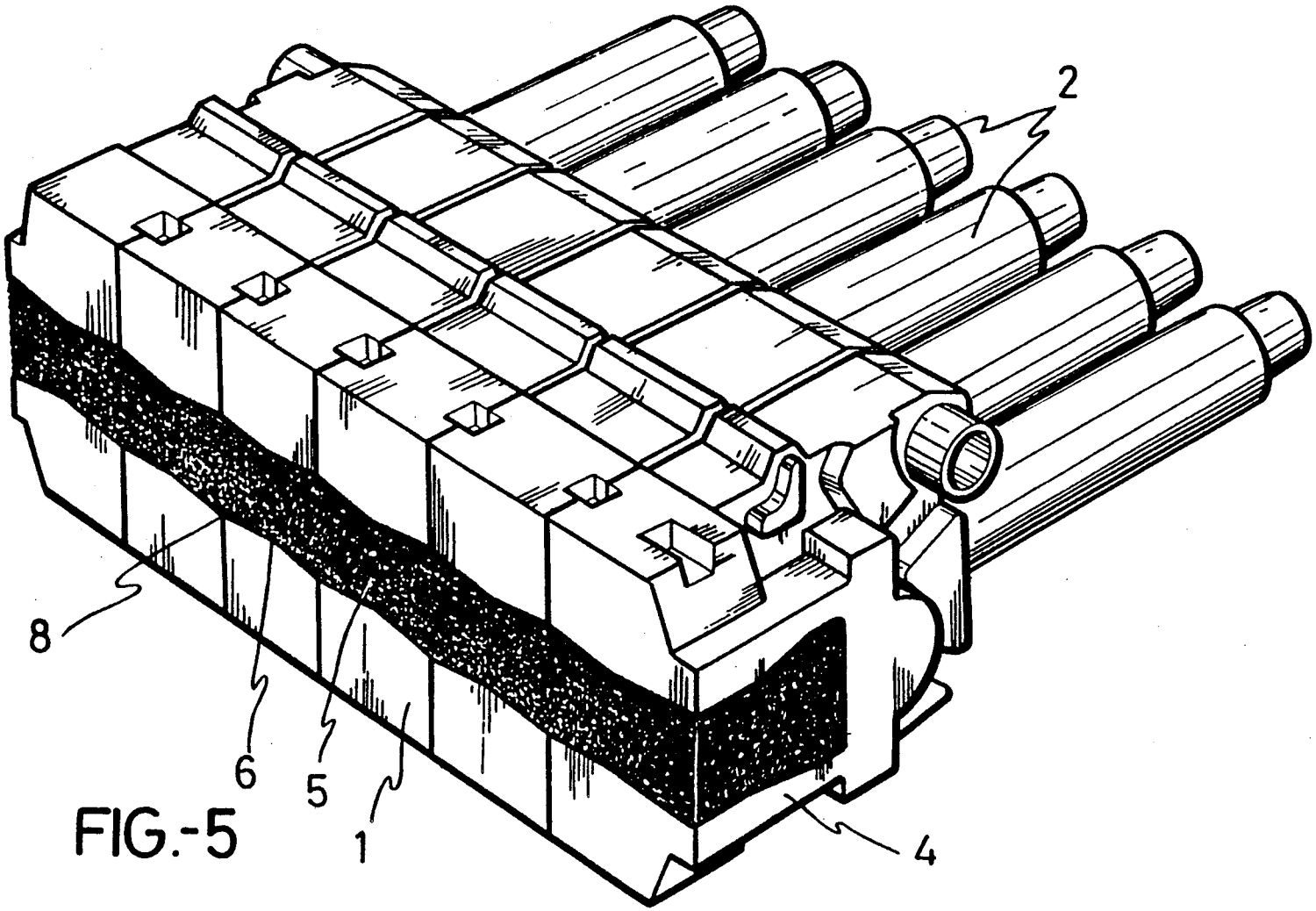
FIG. 5 shows a block corresponding to an engine block of 6 cylinders in line, which differs from from the engine block with eight cylinders in V-shape of FIG. 4.

FIG. 5 shows a block of cores of a different shape to that shown in FIG. 3, but likewise provided with a channel for the provision of filling material to constitute the coupling means between cores.

Figure 6:
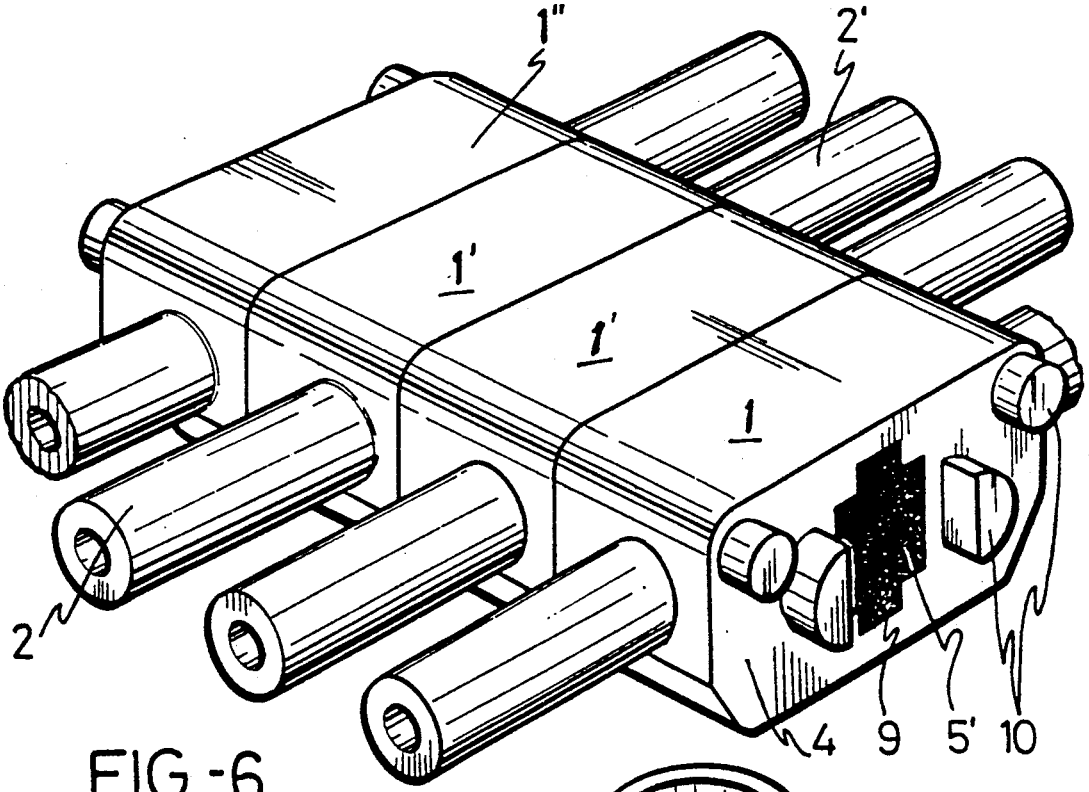
FIG. 6 shows a likewise perspective view of a block of cores corresponding to two engine blocks of 4 facing cylinders of each block, wherein is provided an aperture is provided, likewise occupied by the same filling material acting as a coupling means between the different cores.

FIG. 6 shows a further block of cores which, in addition to the fact that they are of a different shape, have, as means for coupling therebetween, apertures 9 formed therewithin, and which in this embodiment adopt a cross-shaped configuration, but which may obviously adopt any other configuration, such that the filling material 5′, in addition to fulfilling its function as coupling means as in the previous case, constitutes a "bar" within the individual cores which form the block.

Nevertheless, coupling surfaces 4 of cores 1-1′-1″ may include the conventional projections 10 and complementary housings, to ensure perfect relative positioning thereof through engagement of the projections with the housings upon assembly to form the block before the cores are definitively coupled with the filling material 5′.

Figure 7:
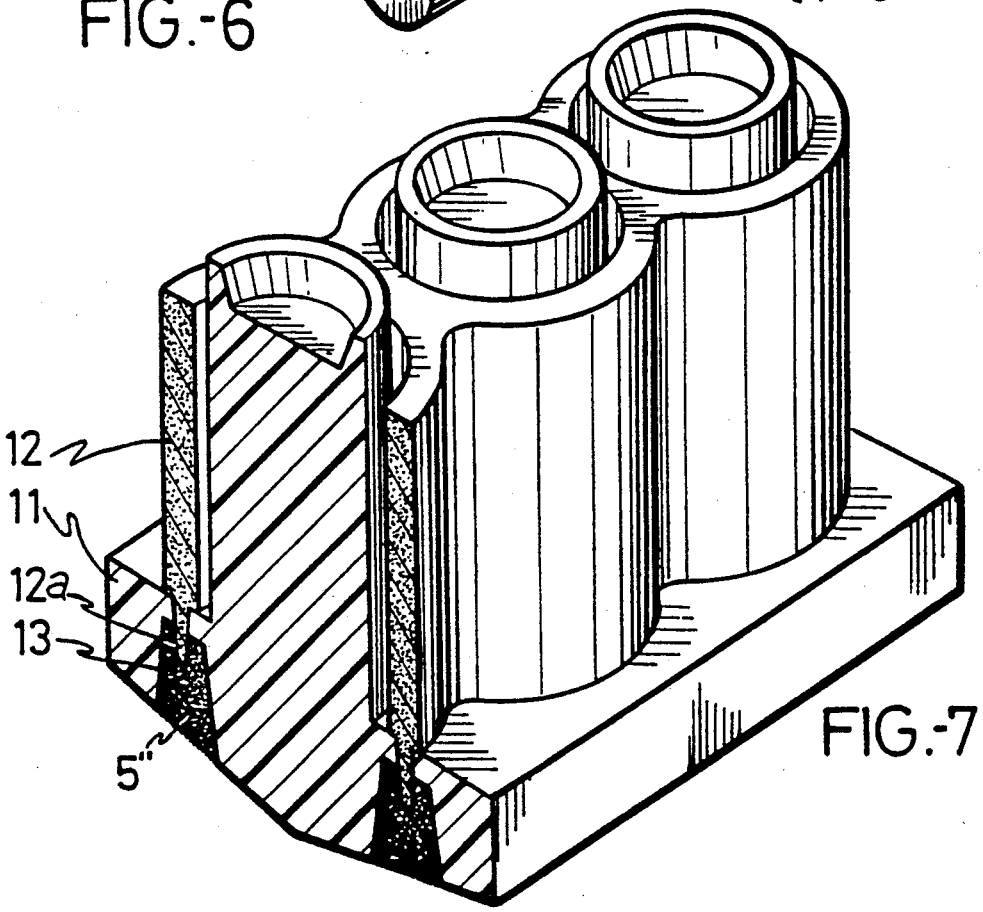
FIG. 7 shows a futher application of the invention, and specifically the coupling of cores which shall make up the cylinders of an engine and the corresponding refrigerating sleeve.

Finally, the embodiment of FIG. 7 again uses a channel 13 for coupling cores 11 and 12 to each other, The channel 13 houses projection **12*a* of core 12 after this projection crosses the apertures of core 11, channel 13 is likewise filled with a mixture of sand and binder material 5″**, as in the preceding embodiments.

Obviously, the exemplified embodiments shown in the drawings are meant merely as an example and correspond to some of the many cases which may arise in practice, all of which comprise the essential features of the present invention, namely the provision in the cores, and in the most suitable area thereof, of a channel or aperture which is operatively faced on assembly with channels of the other cores to form the corresponding block, and which channel is subsequently filled with material 5 which, upon hardening, forms the coupling means between the cores, with a complete operative efficiency, and eliminating all problems inherent to the conventional use of adhesives as a means for coupling of the cores.

Figure 8:
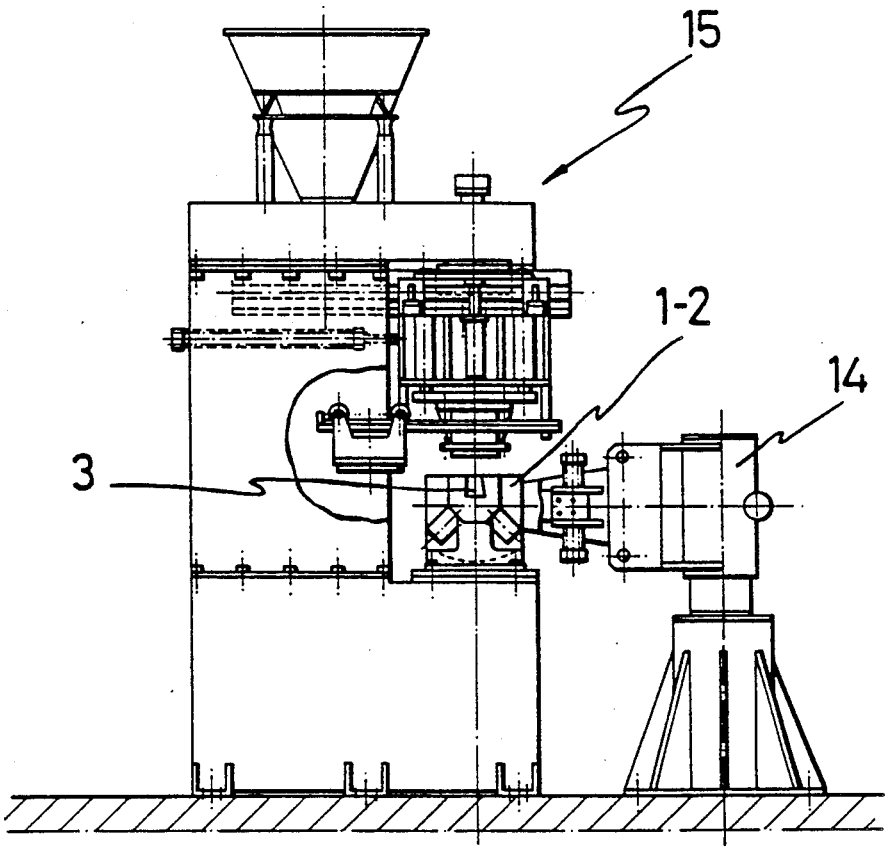
FIG. 8 shows a side elevational view of a preferred embodiment of an auxilliary core producing device, which is used for the introduction of the filling material into the channels or apertures defined in the cores obtained in the previous operative stage, with the aid of a handler.

As aforementioned, once the cores 1-2, provided with their corresponding channel 3, or as the case may be, apertures, have been obtained, the cores 1-2 are duly coupled by means of a handler 14 (FIG. 8), to form the block corresponding to the final products to be obtained, and said block is displaced towards the operative area of a very elementary conventional and simple blowing machine 15, which blowing machine is in charge of providing channel 3 or, as the case may be, the aperture common to the cores of the block with filling material 5 for a obtention of the complementary core, which will act as coupling means between all the main cores, in order to transform the block of initially independent cores, into a single block assembly with sufficient structural stiffness.

I claim:

1. In a method of the formation of foundry core blocks, comprising the steps of forming individual cores with the aid of molds in a first blowing machine and assembling the individual cores into a final core block, the improvement comprising providing in each individual core prior to said assembling step a through hole extending between two lateral surfaces of the core, joining said individual cores with their lateral surfaces facing each other so that all individual cores and all holes thereof are in an axial alignment with each other and a common elongated channel extending in a direction of elongation of said joined individual cores is formed, transmitting said joined individual cores to a second blowing machine, and filling said elongated channel in said second blowing machine with a filling material similar to that of said cores so as to couple said cores with one another upon hardening of said filling material to produce a foundry core block of a final shape.

2. The method as defined in claim 1, wherein said joined individual cores are provisionally coupled by coupling means and held together by means of a handler while being treated in said second blowing machine.

3. The method as defined in claim 1, wherein said filling material is a mixture of sand and binder material introduced in said second blowing machine directly into said common channel.

4. The method as defined in claim 2, wherein said coupling means are removed from said block after said filling material has hardened.

5. The method as defined in claim 1, wherein said holes are formed in an inactive area of said cores.

6. The method as defined in claim 1, wherein said common channel is of a substantially cross configuration.

7. In a method of the formation of foundry core blocks, comprising the steps of forming individual cores with the aid of molds in a first blowing machine and assembling the individual cores into a final core block, the improvement comprising providing in each individual core prior to said assembling step a through hole extending between two lateral surfaces of the core, joining said individual cores with their lateral surfaces facing each other so that all individual cores and all holes thereof are in an axial alignment with each other and a common elongated channel extending in a direction of elongation of said joined individual cores is formed, transmitting said joined individual cores to a second blowing machine and filling said elongated channel in said second blowing machine with a filling material similar to that of said cores so as to couple said cores with one another upon hardening of said filling material to produce a foundry core block of a final shape, wherein outwardly extending projections are formed at a lateral surface of some of said cores, said projections extending into and being held in recesses of other cores upon hardening of said filling material.

* * * * *